US009042200B2

(12) United States Patent
Segal

(10) Patent No.: US 9,042,200 B2
(45) Date of Patent: May 26, 2015

(54) DOWNHOLE TELEMETRY SYSTEM

(75) Inventor: Arkadiy Yurievich Segal, Moscow (RU)

(73) Assignee: Schlumberger Technology Corporation, Cambridge, MA (US)

( * ) Notice: Subject to any disclaimer, the term of this patent is extended or adjusted under 35 U.S.C. 154(b) by 1087 days.

(21) Appl. No.: 12/637,074

(22) Filed: Dec. 14, 2009

(65) Prior Publication Data

US 2010/0149919 A1 Jun. 17, 2010

(30) Foreign Application Priority Data

Dec. 12, 2008 (RU) ..... 2008148991

(51) Int. Cl.
*E21B 47/16* (2006.01)
*E21B 47/18* (2012.01)
*E21B 47/12* (2012.01)

(52) U.S. Cl.
CPC ..... *E21B 47/182* (2013.01); *E21B 47/12* (2013.01)

(58) Field of Classification Search
CPC ..... E21B 47/12
USPC ..... 367/81, 82
See application file for complete search history.

(56) References Cited

U.S. PATENT DOCUMENTS 6,219,301 B1 * 4/2001 Moriarty ..... 367/84
6,874,361 B1 * 4/2005 Meltz et al. ..... 73/152.32
7,397,388 B2 * 7/2008 Huang et al. ..... 340/853.3
7,490,665 B2 * 2/2009 Sandberg et al. ..... 166/60
7,510,000 B2 * 3/2009 Pastor-Sanz et al. ..... 166/60
7,994,932 B2 8/2011 Huang et al.
8,009,059 B2 * 8/2011 Huang et al. ..... 340/853.3
2002/0008634 A1 * 1/2002 Innes ..... 340/854.3
2002/0036085 A1 * 3/2002 Bass et al. ..... 166/250.01
2003/0173088 A1 * 9/2003 Livingstone ..... 166/324
2004/0156265 A1 * 8/2004 Lavrut et al. ..... 367/83
2005/0168349 A1 * 8/2005 Huang et al. ..... 340/854.3
2005/0284625 A1 * 12/2005 Rodney et al. ..... 166/250.01

FOREIGN PATENT DOCUMENTS

RU 2209964 C2 8/2003
RU 2310215 C2 11/2007

* cited by examiner

*Primary Examiner* — Amine Benlagsir

(57) ABSTRACT

A downhole telemetry system usable with a subterranean well comprises at least one pressure pulse generator, at least one pressure transmitter located in an internal tube space in the well and at least one pressure transmitter located in a tubing annulus. The system comprises a packer providing hydraulic isolation of the tubing annulus and at least one transmitter located below the packer and responding to at least one physical quantity characterizing a bottom-hole zone. The system also includes a data encoder located below the packer to read out the transmitter located below the packer and to respond to at least one physical quantity characterizing the bottom-hole zone, a pressure pulse modulator to modulate pressure pulses generated by the pressure pulse generator, a surface-mounted data-collection unit to converts the output data of the transmitters and to provide a surface-mounted data decoder with data for analysis.

5 Claims, 2 Drawing Sheets

DOWNHOLE TELEMETRY SYSTEM

FIELD OF THE INVENTION

The invention relates to the field of geology, namely, to downhole telemetry systems.

A new embodiment of telemetry to be arranged over an acoustic communications channel during the hydraulic fracturing activities is suggested for wells which are stimulated by using tubing. It has been established that acoustic communications between a well head and a tubing annulus is arranged through a packer. The packer is not leaky, but is acoustically transparent. There is therefore an acoustic "well head tubing annulus" channel, so a pressure pulse can be sent from one end of the channel and reliably received on the other end. Data are encoded through pulse modulation, using a modulator located below the packer. This method does not require any additional equipment, except for the above-mentioned modulator to be installed below the packer on the outer side of the tubing.

BACKGROUND OF THE INVENTION

During hydraulic fracturing activities, just like during drilling activities, the availability of real-time data obtained from a bottom hole (e.g., bottom-hole data) can be very useful. It is hard to install wire communications because an unprotected cable will be cut off by a proppant-containing solution. Using a protected cable seems to be an awkward option too. There are solutions suggesting that an optical cable protected by coil tubing should be used, but these solutions imply new operational complications and increase the costs. The solutions associated with the use of a wired drill string may also fail to handle the erosion problem which occurs due to the use of proppant.

There are a number of hydraulic fracturing activities during which a tubing is inserted into a well (e.g., for protection of the well against the high pressure action). A packer is installed above perforations between the tubing and a string, thus forming a tubing annulus. The tubing annulus is filled with a low-viscosity fluid; the tubing annulus pressure is maintained by using a dedicated pump in order to counteract the tubing pressure. So, the tubing annulus is a low-attenuation acoustic waveguide. Embodiments of telemetry facilities which use this channel have been considered in a number of patents (refer to Patents Nos. RU 2209964 dated Aug. 10, 2003, RU 2310215 dated Oct. 7, 2005) and No. US 2005/0168349 published on Aug. 4, 2005. According to US 2005/0168349, a downhole telemetry system contains at least one pressure pulse generator, at least one pressure transmitter located in an internal tubing, at least one pressure transmitter located in a tubing annulus near the well, and a packer.

The main disadvantage of this system is the need to change the packer sealing procedure, which complicates the process of taking measurements by using the downhole telemetry system.

SUMMARY OF THE INVENTION

The problem to be solved by the claimed invention consists in the development of a downhole telemetry system providing a fast and accurate downhole telemetry method.

The technical result achieved with the implementation of the claimed engineering solution consists in the development of a downhole telemetry system which eliminates the need to change the packer sealing procedure and, consequently, simplifies the process of taking measurements by using the claimed system.

The said technical result is achieved due to the fact that a downhole telemetry system contains at least one pressure pulse generator, at least one pressure transmitter located in an internal tube space in a well head, at least one pressure transmitter located in a tubing annulus near the well, and a packer providing hydraulic isolation of the tubing annulus. The system additionally contains at least one transmitter which is located below the packer and which responds to at least one physical quantity characterizing a bottom-hole zone, a data encoder which is located below the packer and which reads out the transmitter located below the packer and responding to at least one physical quantity characterizing the bottom-hole zone, a pressure pulse modulator which modulates pressure pulses generated by the pressure pulse generator and which is located in the tubing annulus below the packer, a surface-mounted data-collection unit which converts output data of the transmitters and which provides a surface-mounted data decoder with data for analysis.

In addition, the pressure pulse modulator can be designed in the form of a valved chamber.

In addition, the pressure pulse generator is a mechanical device capable of increasing or decreasing the pressure. In addition, the physical quantity which characterizes the bottom-hole zone and which the transmitter located below the packer responds to is the pressure or temperature.

BRIEF DESCRIPTION OF THE DRAWINGS

The disclosure is illustrated by drawings wherein.

DETAILED DESCRIPTION OF THE PREFERRED EMBODIMENTS

Figure 1:
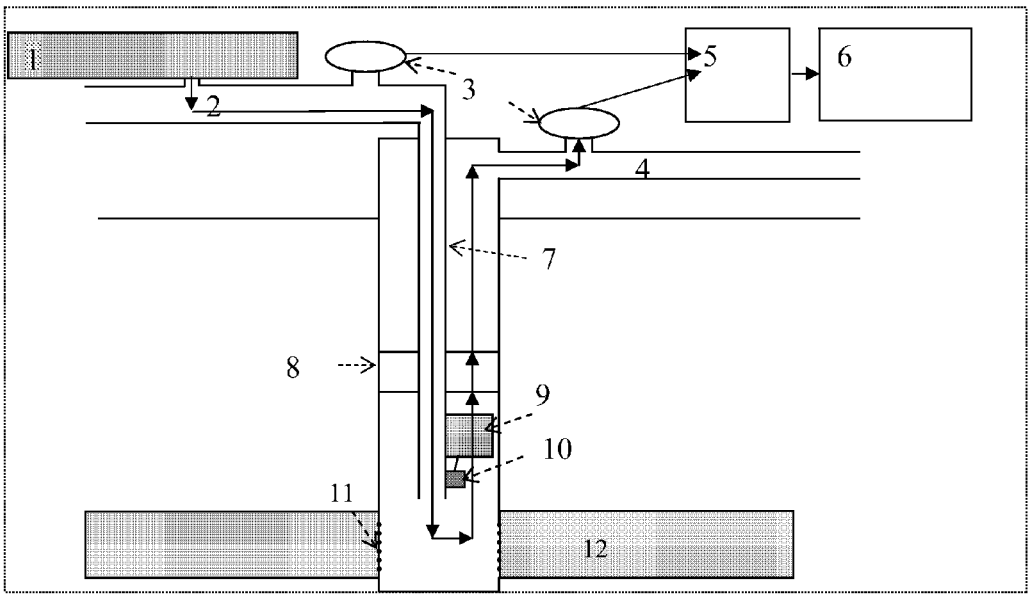
FIGS. 1 and 2 show the general view of the downhole telemetry system.
Figure 2:
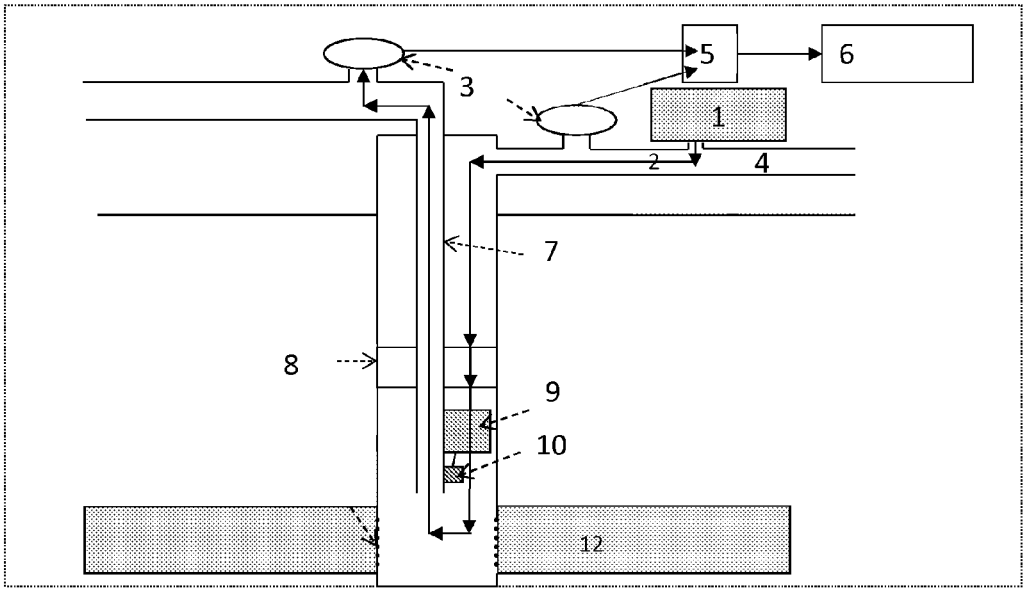

The invention is illustrated with the drawings where FIGS. 1 and 2 show the general view of the downhole telemetry system, with the following elements: Pressure pulse generator (1), Fracturing fluid feed line (2), Pressure transmitters (3), Tubing annulus line (4), Data-collection unit (5), Data decoder (6), Tubing (7), Packer (8), Pressure pulse modulator (9), Transmitters system and data encoder (10), Perforations (11) and Hydraulic fracture (12).

This invention relates to downhole telemetry systems, i.e., to data encoding and transmission systems for encoding and transmitting data from a well point located at a great depth completed in such a way that there is an internal tube, a tubing annulus exists between this tube and a well wall, while a packer provides hydraulic isolation of at least two portions (the upper one and the lower one) of the tubing annulus. The above-mentioned system includes:

at least one pressure pulse generator (1) connected either to an internal tube space or to the tubing annulus; this generator is a mechanical device (such as a pump, a hydraulic valve, etc.) capable of increasing or decreasing pressure in a certain point in the tubing according to a certain schedule (e.g., generating a pressure pulse of a certain type a certain number of times per unit of time);

at least one pressure transmitter (3) to measure the internal tube space pressure, preferably (but not compulsorily) in a well head, and at least one pressure transmitter to measure the tubing annulus pressure;

a packer (8);

at least one transmitter (10) which is located below the packer and which responds to at least one physical quantity characterizing a bottom-hole zone (e.g., to the pressure or temperature);

a data encoder (10) which is located below the packer in the well and which reads out the transmitter and converts these readings into an encoded sequence of signals which control the pulse modulator dynamics;

a pressure pulse modulator (9) which is preferably installed on the outer side of the tubing (7) below the packer (8) and which is capable of changing amplitude characteristics or phase characteristics of a pressure pulse generated by the pressure pulse generator (1); this modulator is a mechanical device which is controlled by the data encoder and which changes the hydraulic characteristics (such as hydraulic impedance) of a segment of the tubing where this modulator is installed;

a data-collection unit (5) which converts the output data of the transmitters into analog or digital data and which preferably (but not compulsorily) provides the synchronous data recoding over all data-collection channels; this unit consists of a sequence of electronic components which receive electrical signals generated by the transmitters and which send these signals to the input of an analog-to-digital or analog converter providing a data decoder with data for analysis;

the surface-mounted data decoder (6) capable of converting a modulated signal into data equivalent to at least that portion of information, which is read out by the transmitters, with data quality and quantity reductions being possible.

The pressure pulse modulator (9) can be made in the form of a valve chamber to be installed on the section of the tubing (7), located below the packer (8), with the chamber valves being capable of opening and/or closing at least one chamber port in order to connect the internal portion of the chamber to the well under the action of the signal arriving from the encoder.

Another embodiment of the pressure pulse modulator (9) can be represented by a chamber or a set of chambers capable of expanding or contracting, thus reducing or increasing a clearance between the tubing (7) and the well wall, under the action of the signal arriving from the data encoder (10). The chamber or the set of chambers are installed on the section of the tubing (7), located below the packer (8).

Other embodiments of the pressure pulse modulator (9) are also possible. The selection of a specific embodiment will depend on the detailed geometry of the annulus below the packer (8) and can be specified by acoustic filter specialists.

A signal is generated by the pressure pulse generator (1) connected to the fracturing fluid feed line (2) and propagates at a high speed of about 1 km/s into the depth of the well where this signal is reflected from the fracture system and from the bottom-hole zone and partially penetrates into the tubing annulus where it undergoes some changes introduced by the pressure pulse modulator (9) and passes through the packer (8) and propagates upwards to be recorded there by the tubing annulus pressure transmitter (3). Alternatively, the signal is generated in the tubing annulus and is recorded in the fracturing fluid feed line (2) on the surface. The pulse propagation path is the same in this case.

The invention claimed is:

1. A downhole telemetry system usable within a completed subterranean well including an internal tube space, tubing annulus and a packer, the downhole telemetry system comprising:

at least one pressure pulse generator is configured to generate a pressure pulse, the at least one pressure pulse generator connected to at least one of (i) the internal tube space of the well, wherein the generated pressure pulse propagates downwards into the internal tube space and then upwards through the packer to the tubing annulus, and (ii) the tubing annulus, wherein the generated pressure pulse propagates downwards into the tubing annulus and then upwards through the packer to the internal tube space, at least one first pressure transmitter located in the internal tube space to measure a pressure of the internal tube space when the generated pressure pulse propagates downwards into the tubing annulus and then upwards through the packer to the internal tube space, at least one second pressure transmitter located in the tubing annulus to measure a pressure of the tubing annulus when the generated pressure pulse propagates downwards into the internal tube space and then upwards through the packer to the tubing annulus, the packer providing hydraulic isolation of the tubing annulus, at least one transmitter located below the packer to respond to at least one physical quantity characterizing a bottom-hole zone, a data encoder located below the packer to read out the at least one transmitter located below the packer, a pressure pulse modulator adapted to change amplitude characteristics or phase characteristics of the pressure pulse generated by the at least one pressure pulse generator and located on the tubing annulus below the packer, wherein the pressure pulse modulator is a mechanical device which is controlled by the data encoder and which changes hydraulic characteristics of a tube segment where the pressure pulse modulator is installed, a surface-mounted data-collection unit which converts an output data of the at least one first pressure transmitter and the at least one second pressure transmitter into analog or digital data, and a surface-mounted data decoder to receive and analyze the analog or digital data from the surface-mounted data-collection unit.

2. The system of claim 1, wherein the pressure pulse modulator has a form of a valve chamber.

3. The system of claim 1, wherein the at least one pressure pulse generator is a mechanical device that increases or decreases the pressure pulse.

4. The system of claim 1, wherein the at least one physical quantity, which characterizes the bottom-hole zone and which the at least one transmitter located below the packer responds to, is a pressure or a temperature.

5. The system of claim 1, wherein the at least one first pressure transmitter is located in the internal tube space in a well head.

* * * * *